US012343647B2

(12) United States Patent
Shao et al.

(10) Patent No.: US 12,343,647 B2
(45) Date of Patent: Jul. 1, 2025

(54) EARLY EDUCATION TOY

(71) Applicants: ALPHA GROUP CO., LTD., Guangdong (CN); GUANGZHOU ALPHA CULTURE COMMUNICATIONS CO., LTD., Guangdong (CN)

(72) Inventors: Haojun Shao, Guangdong (CN); Chunlan Guo, Guangdong (CN); Rui Liao, Guangdong (CN); Longshan Ou, Guangdong (CN)

(73) Assignees: ALPHA GROUP CO., LTD., Guangdong (CN); GUANGZHOU ALPHA CULTURE COMMUNICATIONS CO., LTD., Guangdong (CN)

( * ) Notice: Subject to any disclaimer, the term of this patent is extended or adjusted under 35 U.S.C. 154(b) by 441 days.

(21) Appl. No.: 17/909,314

(22) PCT Filed: Feb. 27, 2021

(86) PCT No.: PCT/CN2021/078288
§ 371 (c)(1),
(2) Date: Sep. 2, 2022

(87) PCT Pub. No.: WO2021/175167
PCT Pub. Date: Sep. 10, 2021

(65) Prior Publication Data

US 2023/0191241 A1 Jun. 22, 2023

(30) Foreign Application Priority Data

Mar. 3, 2020 (CN) ..... 202020247103.9

(51) Int. Cl.
*A63F 9/24* (2006.01)
*A63F 7/02* (2006.01)
*A63F 9/00* (2006.01)

(52) U.S. Cl.
CPC ..... *A63F 9/24* (2013.01); *A63F 7/02* (2013.01); *A63F 9/0098* (2013.01); *A63F 2009/2452* (2013.01); *A63F 2009/2476* (2013.01)

(58) Field of Classification Search
CPC .. A63F 9/24; A63F 7/02; A63F 9/0098; A63F 2009/2452; A63F 2009/2476;
(Continued)

(56) References Cited

U.S. PATENT DOCUMENTS 2,870,279 A 1/1959 Cohn
3,264,782 A * 8/1966 Glass ..... A63H 17/006 446/435

(Continued)

FOREIGN PATENT DOCUMENTS

CN 201959538 U 9/2011
CN 202427119 U 9/2012

(Continued)

OTHER PUBLICATIONS

Damien Bagarry, "Extended European Search Report for EP Application No. 21764840.1", Feb. 15, 2024, EPO, Germany.

*Primary Examiner* — Peter J Iannuzzi
(74) *Attorney, Agent, or Firm* — Bridgeway IP Law Group, PLLC; Jihun Kim

(57) ABSTRACT

An early education toy is configured to be used with a plurality of balls, and includes: a housing having a ball inlet and a ball outlet, and including a slideway therein, the slideway having an end connected with the ball inlet and another end connected with the ball outlet; a rotating part
(Continued)

pivotably arranged to a bottom of the housing; a blocking part arranged in the housing, at least part of the blocking part being arranged in the ball outlet or at the end of the slideway adjacent to the ball outlet and configured to reciprocate to stop or release the ball; a driving part connected with the rotating part and the blocking part, and configured to drive the blocking part to move and to drive the rotating part to rotate relative to the housing.

9 Claims, 5 Drawing Sheets

(58) Field of Classification Search
CPC .. A63F 7/307; A63F 2009/2402; A63F 9/183; A63F 2009/2454
See application file for complete search history.

(56) References Cited

U.S. PATENT DOCUMENTS

| | | | | |
|---|---|---|---|---|
| 4,128,949 | A | 12/1978 | Marason, Jr. et al. | |
| 2012/0171924 | A1* | 7/2012 | Karnick ..... | A63H 17/05 446/236 |

FOREIGN PATENT DOCUMENTS

| | | | |
|---|---|---|---|
| CN | 107875646 | A | 4/2018 |
| CN | 207856320 | U | 9/2018 |
| CN | 109568927 | A | 4/2019 |
| CN | 109946760 | A | 6/2019 |
| CN | 209237303 | U | 8/2019 |
| CN | 212016697 | U | 11/2020 |
| DE | 3306048 | A1 | 8/1984 |

* cited by examiner

EARLY EDUCATION TOY

CROSS REFERENCE TO RELATED APPLICATIONS

The present application is a national phase entry under 35 USC § 371 of International Application No. PCT/CN2021/078288, filed on Feb. 27, 2021, which claims the benefit of and priority to Chinese Application No. 202020247103.9, filed on Mar. 3, 2020, the entire disclosures of which are incorporated herein by reference.

FIELD

The present disclosure relates to a field of toys, and more particularly to an early education toy.

BACKGROUND

Most of the existing toys for early childhood education have simple structures and single functions, and also have less interest and entertainment as a whole, so that they cannot stimulate children's fun of play, and provide a poor effect on early education.

SUMMARY

An early education toy according to embodiments of the present disclosure is configured to be used with a plurality of balls, and includes: a housing having a ball inlet and a ball outlet, and including a slideway therein, the slideway having an end connected with the ball inlet and another end connected with the ball outlet; a rotating part pivotably arranged to a bottom of the housing; a blocking part arranged in the housing, at least part of the blocking part being arranged in the ball outlet or at the end of the slideway adjacent to the ball outlet and configured to reciprocate to stop or release the ball; a driving part connected with the rotating part and the blocking part, and configured to drive the blocking part to move and to drive the rotating part to rotate relative to the housing.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
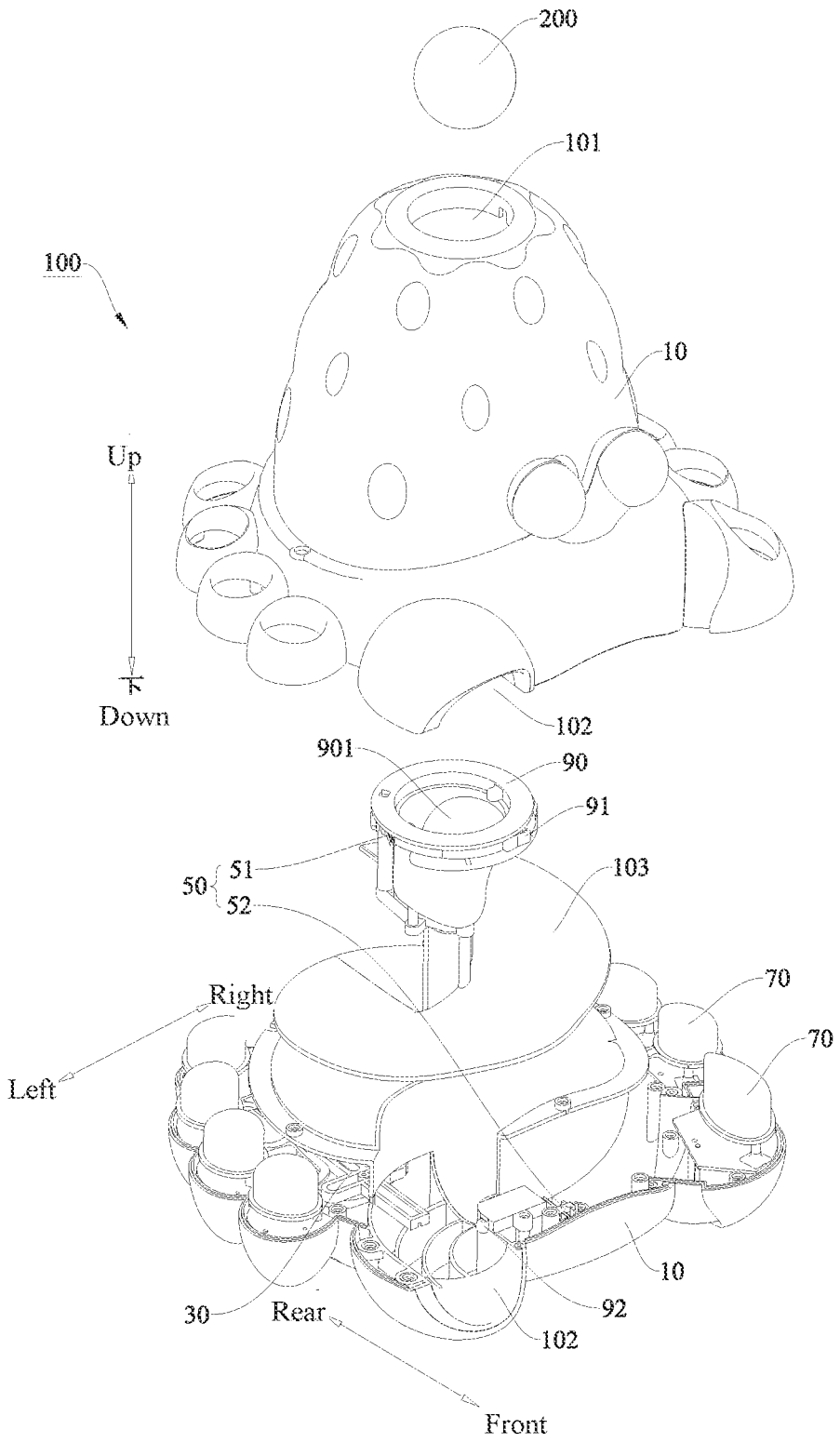
FIG. 1 is a schematic exploded view of an early education toy in an embodiment of the present disclosure.

Reference will be made in detail to embodiments of the present disclosure, examples of the embodiments are shown in the drawings, and the same or similar reference numerals refer to the same or similar elements or elements with the same or similar functions throughout. The embodiments described in the following with reference to the drawings are exemplary, and are only used to explain the present, rather than limits to the present disclosure.

In the descriptions of the present disclosure, relative terms such as "length", "lower", "upper", "front", "rear", "left", "right", "vertical", "horizontal", "top", "bottom", "inner", "outer", "axial", "circumferential" as well as derivative thereof should be construed to refer to the orientation as then described or as shown in the drawings under discussion. These relative terms are for convenience and simplification of the descriptions of the present disclosure and do not indicate or imply that the indicated device or element must have a particular orientation or be constructed or operated in a particular orientation, and thus cannot be construed as a limitation to the present disclosure.

In addition, features defined with "first" and "second" may include one or more of these features explicitly or implicitly, which intends to distinguish the described features, without order or importance.

In the descriptions of the present disclosure, unless expressly specified otherwise, "a plurality of" means two or more than two.

In the descriptions of the present disclosure, it should be noted that, unless otherwise expressly specified and defined, terms such as "mounting", "interconnection" and "connection" shall be understood broadly, and may be, for example, fixed connections, detachable connections, or integral connections; may also be mechanical or electrical connections; may also be direct connections or indirect connections via intervening media; may also be inner communications of two elements. For those skilled in the art, the specific meaning of the above terms in the present disclosure can be understood according to the specific situations.

An early education toy 100 according to embodiments of the present disclosure is described with reference to the drawings.

Figure 2:
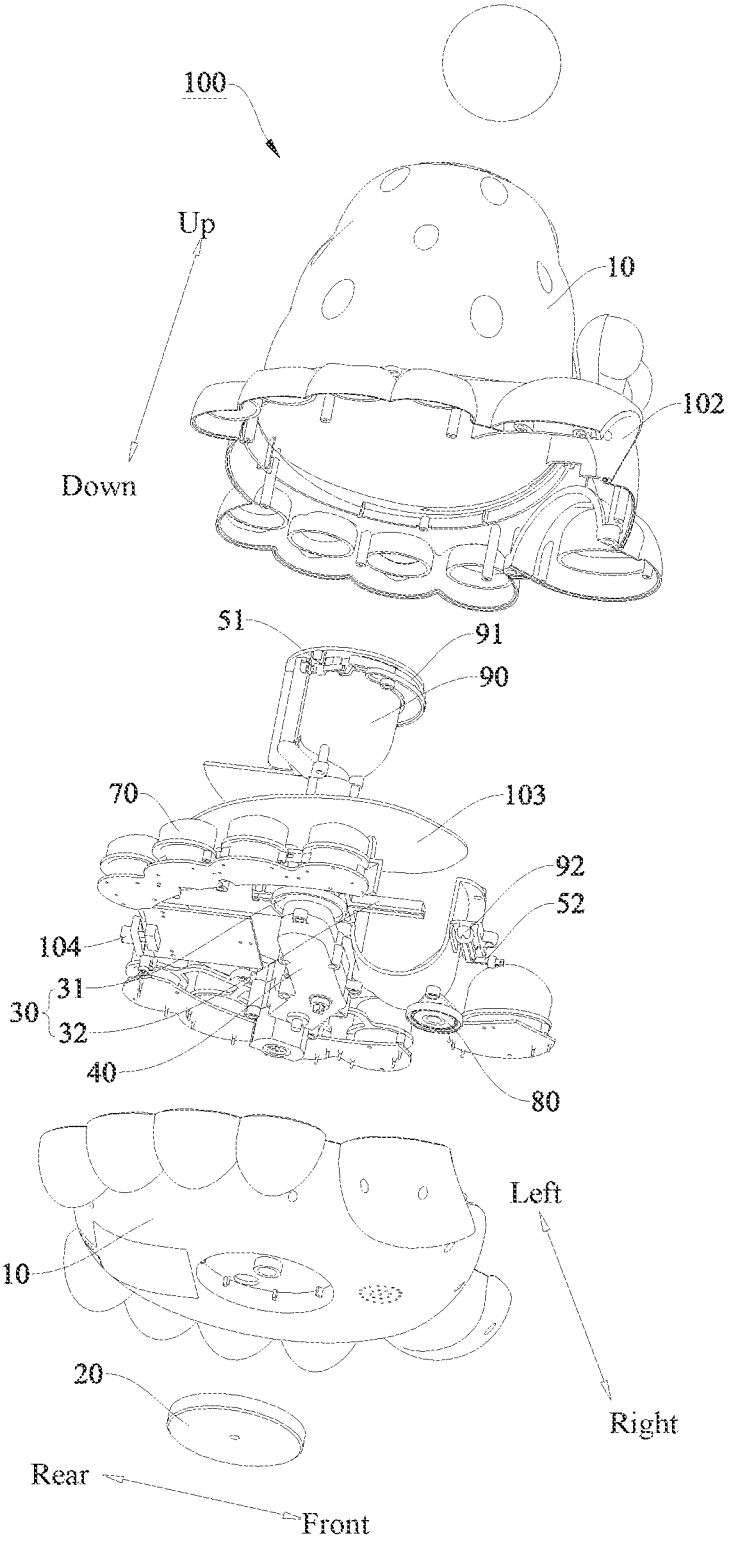
FIG. 2 is another schematic exploded view of an early education toy in an embodiment of the present disclosure.
Figure 3:
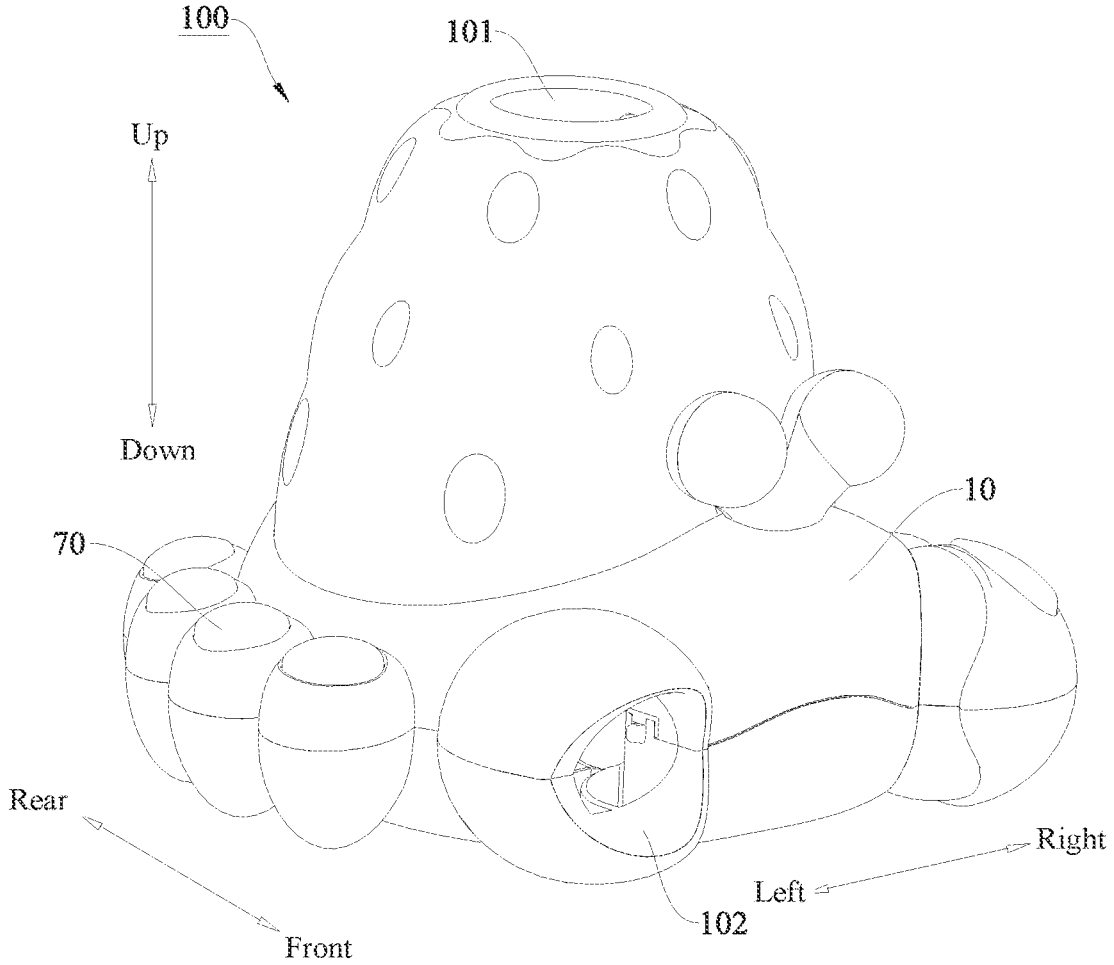
FIG. 3 is a perspective view of an early education toy in an embodiment of the present disclosure.

As shown in FIG. 1 to FIG. 3, the early education toy 100 according to the embodiments of the present disclosure is configured to be used with a plurality of balls, and includes a housing 10, a rotating part 20, a blocking part 30, and a driving part 40.

The housing 10 have a ball inlet 101 and a ball outlet 102, and includes a slideway 103 therein, and the slideway 103 have an end connected with the ball inlet 101 and another end connected with the ball outlet 102. When the early education toy 100 is used with the plurality of balls 200, the balls 200 may enter from the ball inlet 101 and then roll out of the ball outlet 102 through the slideway 103.

The rotating part 20 is pivotably arranged to a bottom of the housing 10. In other words, a bottom of the rotating part 20 is in contact with the ground or a platform, and the housing 10 can realize a rotation motion through the rotating part 20, thus enhancing the entertainment of play.

The blocking part 30 is arranged in the housing 10, and at least part of the blocking part 30 is arranged in the ball outlet 102 or at the end of the slideway 103 adjacent to the ball outlet 102 and configured to reciprocate to stop or release the ball 200. For example, part of the blocking part 30 may be arranged in the ball outlet 102 to stop the ball 200 and prevent the ball 200 from rolling out, and when the part of the blocking part 30 moves to be outside the ball outlet 102, the ball 200 is released and rolls out of the ball outlet 102. Part of the blocking part 30 may also be arranged at the end of the slideway 103 adjacent to the ball outlet 102, so as to block the ball 200 in the slideway 103 and prevent the ball 200 from rolling out. When the part of the blocking part 30 moves to be outside the slideway 103, the ball 200 is released and rolls out of the ball outlet 102. Since the part of the blocking part 30 is configured to reciprocate, the part of the blocking part 30 can be restored after the ball 200 is released, so as to prevent the next ball 200 from moving, thus stopping and releasing the ball 200 again.

The driving part 40 is connected with the rotating part 20 and the blocking part 30, and the driving part 40 is configured to drive the blocking part 30 to move and to drive the rotating part 20 to rotate relative to the housing 10, so as to provide the power required for the movements of the rotating part 20 and the blocking part 30.

It should be noted that the early education toy 100 of the present disclosure can be used for early education of children. When playing, the children put the balls 200 into the ball inlet 101 of the housing 10 one by one, the ball 200 passes through the slideway 103, reaches the vicinity of the ball outlet 102, and is stopped by the blocking part 30. A corresponding starting switch may be arranged on the housing 10, and the driving part 40 may be turned on by controlling the switch, so that the blocking part 30 releases the ball 200, and finally, the ball 200 rolls out of the ball outlet 102. The whole process of ball input and output is convenient for learning to count, and have good effects on the early education of children. Moreover, the driving part 40 drives the rotating part 20 to rotate, so that the toy 100 can rotate one circle or more circles, thus greatly enhancing the entertainment.

It is worth noting that the appearance of the housing 10 may be made into a shape of a cartoon character or animal, thus further increasing the interest of the toy 100. For example, the shape of the housing 10 is made into a crab, the ball inlet 101 is arranged on the top of the crab, and the ball outlet 102 is arranged at one of the claws of the crab, so as to simulate the action of the crab swallowing and spitting the ball 200 as a whole. The ball 200 is put into the top of the crab by the children, and then is spit out of the claw. The crab rotates one circle and then faces the children again, which increases the interest, and is conducive to stimulating the fun and positivity of play.

The early education toy 100 according to the embodiments of the present disclosure facilitates the early education of children for counting by being used with the ball 200, the blocking part 30 and the driving part 40 function together to achieve the game play of the toy swallowing and spitting the ball 200, and the rotating part 20 and the driving part 40 function together to achieve the rotation of the toy. Thus, the whole toy has great interest and entertainment, which tends to stimulate the children's fun of play.

In some embodiments, as shown in FIG. 1, the slideway 103 is a spiral slideway from top to bottom and having an outer ring gradually increasing. The spiral slideway extends the falling stroke of the ball 200 and hence the effect of ball output can be ensured. The ball inlet 101 is arranged in a top of the housing 10, which can ensure that the ball 200 has a sufficient falling height, so as to achieve a high speed of ball output when the ball is output, thus obtaining a good effect of ball output.

In some embodiments, the early education toy 100 further includes a counting part 50 and a plurality of light-emitting parts (not shown in the drawings). The counting part 50 is arranged to the ball inlet 101 or/and the ball outlet 102 to count the number of entering balls or exiting balls. For example, the counting part 50 is arranged to the ball inlet 101 to count the number of the balls 200 put in; the counting part 50 may also be arranged to the ball outlet 102 to count the number of the balls 200 rolling out; the counting part 50 may also be arranged to both the ball inlet 101 and the ball outlet 102, so as to count the number of the balls 200 put in and the number of the balls 200 rolling out. The plurality of light-emitting parts are all arranged on the housing 10 and electrically connected with the counting part 50. Each of the light-emitting parts represents a different number of the balls 200. In other words, the plurality of light-emitting parts may be marked with different numbers, and when different numbers of the balls 200 are put in, the light-emitting parts marked with corresponding numbers light up, indicating how many balls 200 are put in. For example, when the shape of the housing 10 is made into a crab which has eight legs and two claws, nine light-emitting parts are provided, and the nine light-emitting parts are arranged on the eight legs and one claw of the crab, and are marked with numbers 1, 2, 3, 4, 5, 6, 7, 8, 9 in sequence. When one ball 200 is put in, the light-emitting part marked the number 1 lights up, and when the second ball 200 is put in, the light-emitting part marked the number 2 lights up, and so on. Finally, the light-emitting part marked with the number 9 lights up. In this way, a play method of a game mode can be formed, i.e., after the ball is put in at will, the light of the light-emitting part lights up or flashes, and the crab rotates and spits out the ball. This play method further improves the interest due to the addition of the light effect.

In some embodiments, as shown in FIG. 1, the early education toy 100 further includes a plurality of buttons 70, and the plurality of buttons 70 are arranged in one to one correspondence with the plurality of light-emitting parts and electrically connected with the driving part 40. After each button 70 is triggered, the driving part 40 drives the blocking part 30 to move to release a corresponding number of the balls 200. In other words, the button 70 and the light-emitting part are arranged correspondingly. For example, the light-emitting part is arranged in the button 70, and the button 70 is configured as the switch for the driving part 40. The driving part 40 is started to move the blocking part 30 to release the ball 200, when the light-emitting part and the button 70 are pressed at the same time, so as to clear up all of the balls 200 from the slideway 103. Meanwhile, the rotating part 20 rotates one circle or more circles, thus enhancing the entertainment.

In some embodiments, as shown in FIG. 2, the early education toy 100 further includes a sound-producing part 80, and the sound-producing part 80 is electrically connected with the plurality of buttons 70, and configured to report the number of released balls by voice after the button 70 is triggered. In combination with the sound-producing part 80, a play method of a learning mode can be formed. For example, the sound-producing part 80 can count by voice according to the number of the balls 200 put in, so that the early education toy 100 realizes the function of reading numbers by memory and helps the children to recognize the numbers. Then, the children press the light-emitting part and the button 70, all of the balls 200 in the housing 10 are cleared up after the crab rotates, thus improving the children's learning ability and realizing the early education function. It is worth noting that, the sound-producing part 80 may also be connected to the controller, so as to form a play method of a question-and-answer mode, thus realizing the interaction with the children. For example, the button 70 is pressed according to the number of the entering balls prompted by voice, and the sound-producing part 80 generates an encouraging music when the children make a correct operation, thus further enhancing the early education effect.

In some embodiments, as shown in FIG. 1 and FIG. 2, the counting part 50 includes a first leaf switch 51 and s second leaf switch 52. The ball inlet 101 includes a ball sleeve 90. The first leaf switch 51 is arranged on the ball sleeve 90, and a leaf of the first leaf switch is triggered when the ball 200 enters the ball inlet 101, that is, when the first ball 200 enters, the first leaf switch 51 is triggered for the first time and the count is 1, and when the second ball 200 enters, the first leaf switch 51 is triggered for the second time and the count is 2, and so on, in which manner the number of the entering balls is counted. The second leaf switch 52 is arranged on the ball outlet 102, and a leaf of the second leaf switch 52 is triggered when the ball 200 exits the ball outlet 102. Similar to the principle of counting the number of the entering balls, when the first ball 200 rolls out, the second leaf switch 52 is triggered for the first time and the count is 1, and when the second ball 200 rolls out, the second leaf switch 52 is triggered for the second time and the count is 2, and so on, in which manner the number of the exiting balls is counted.

Figure 4:
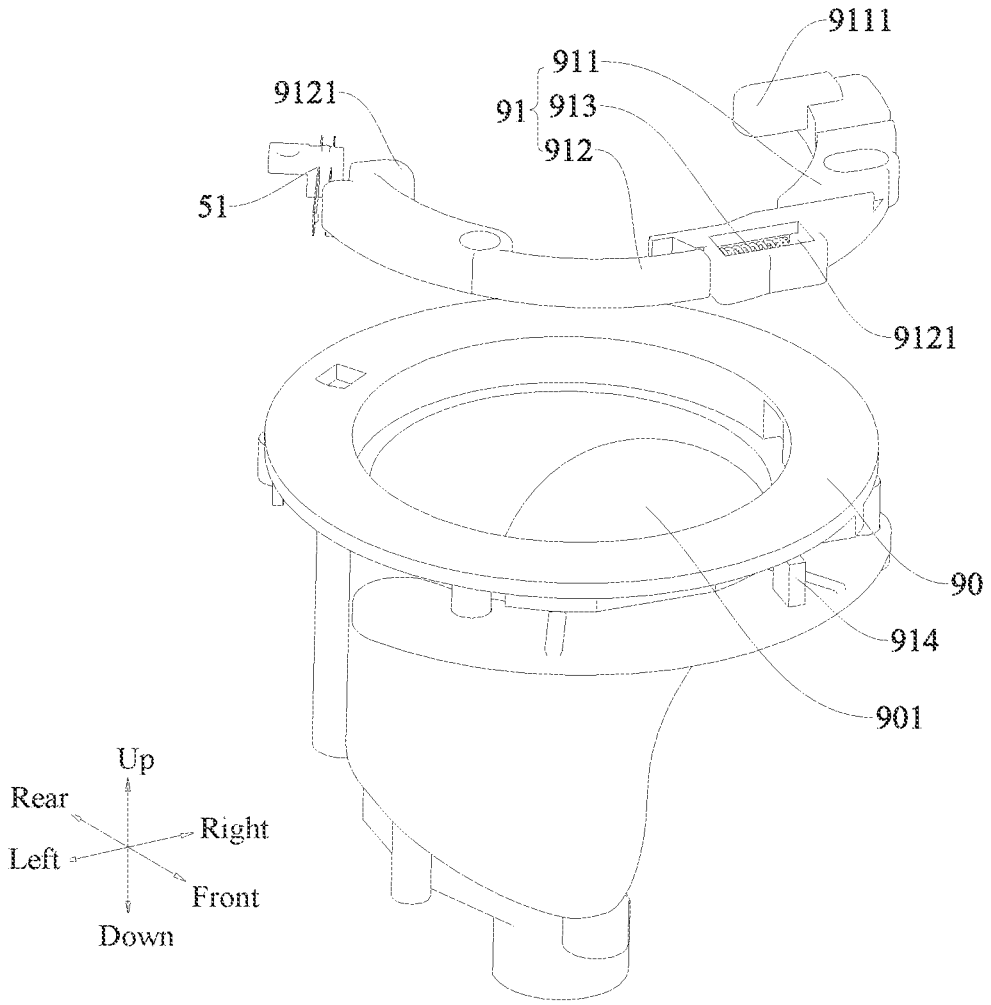
FIG. 4 is a schematic exploded view of a ball sleeve and a mis-trigger preventing mechanism in an embodiment of the present disclosure.

In some embodiments, the ball sleeve 90 is sleeved in the ball inlet 101. As shown in FIG. 4, the ball sleeve 90 has an opening in its top and a through hole 901 in its side, the through hole 901 is communicated with the slideway 103, and the ball 200 is put in from the opening of the ball sleeve 90 and rolls into the slideway 103 through the through hole 901, so that it is convenient to put in the ball 200.

In some embodiments, as shown in FIG. 4, a mis-trigger preventing mechanism 91 is arranged on the ball sleeve 90, the mis-trigger preventing mechanism 91 includes a pivotable first trigger 911, a pivotable second trigger 912, and an elastic member 913. The first trigger 911 have a first contact part 9111 extending into the ball sleeve 90, the second trigger 912 have a second contact part 9121 extending into the ball sleeve 90, a side of the second contact part 9121 away from the ball sleeve 90 abuts against the leaf of the first leaf switch 51, and the elastic member 913 is arranged between the first trigger 911 and the second trigger 912. In other words, the elasticity of the elastic member 913 can keep the first contact part 9111 of the first trigger 911 and the second contact part 9121 of the second trigger 912 always in the ball sleeve 90. In this way, only when the ball 200 is put into the ball sleeve 90, the first contact part 9111 and the second contact part 9121 can be triggered, thus leading the first leaf switch 51 to count. Due to the elasticity of the elastic member 913, the first contact part 9111 and the second contact part 9121 tend not to be triggered when the ball 200 is not put in, thus achieving a function of preventing mis-trigger.

Specifically, as shown in FIG. 4, the first trigger 911 is an arc-shaped plate, a first end of the first trigger 911 is rotatably connected to the ball sleeve 90, and a second end of the first trigger 911 is configured as the first contact part 9111. The second trigger 912 is an arc-shaped plate, a first end of the second trigger 912 is rotatably connected to the ball sleeve 90, and a second end of the second trigger 912 is configured as the second contact part 9121. In this way, when the ball 200 is put in, the ball 200 is in contact with the first contact part 9111 and the second contact part 9121, and pushes the first trigger 911 and the second trigger 912 to rotate, so that the ball 200 can be put into the ball sleeve 90, and the second trigger 912 triggers the first leaf switch 51 to realize counting while rotating. The first trigger 911 and the second trigger 912 prevent mis-trigger in this rotation manner, thus providing a simple structure, and obtaining a good effect of preventing mis-trigger.

Specifically, as shown in FIG. 4, the elastic member 913 is a spring, an accommodating groove 9112 is formed in the first end of the first trigger 911 adjacent to the second trigger 912, the elastic member 913 is located in the accommodating groove 9112, the ball sleeve 90 has a positioning plate 914 located in the accommodating groove 9112, a first end of the spring abuts against a wall of the accommodating groove 9112 and a second end of the spring abuts against the positioning plate 914, and the first end of the second trigger 912 abuts against the first trigger 911. In this way, in a natural state, the spring stretches and the force of the spring keeps the first trigger 911 tightly against a side wall of the ball sleeve 90. Meanwhile, the second trigger 912 can also abut tightly against the side wall of the ball sleeve 90, due to the abutting between the first trigger 911 and the second trigger 912. When the ball 200 passes through the ball sleeve 90, the compressed spring is restored, and the elasticity resets the first trigger 911. The second trigger 912 can also be reset, also due to the abutting between the first trigger 911 and the second trigger 912.

In some embodiments, as shown in FIG. 1 and FIG. 2, a movable third trigger 92 is arranged on the housing 10, an end of the third trigger 92 extends into the ball outlet 102 and another end of the third trigger 92 abuts against the leaf of the second leaf switch 52. For example, the third trigger 92 may be slidably arranged on the housing 10. When the ball 200 rolls out, the third trigger 92 is pushed to move out in a direction facing away the ball outlet 102, so that the third trigger 92 triggers the leaf of the second leaf switch 52, thus counting the number of the exiting balls. In this way, it is convenient for the ball 200 to trigger the second leaf switch 52.

Figure 5:
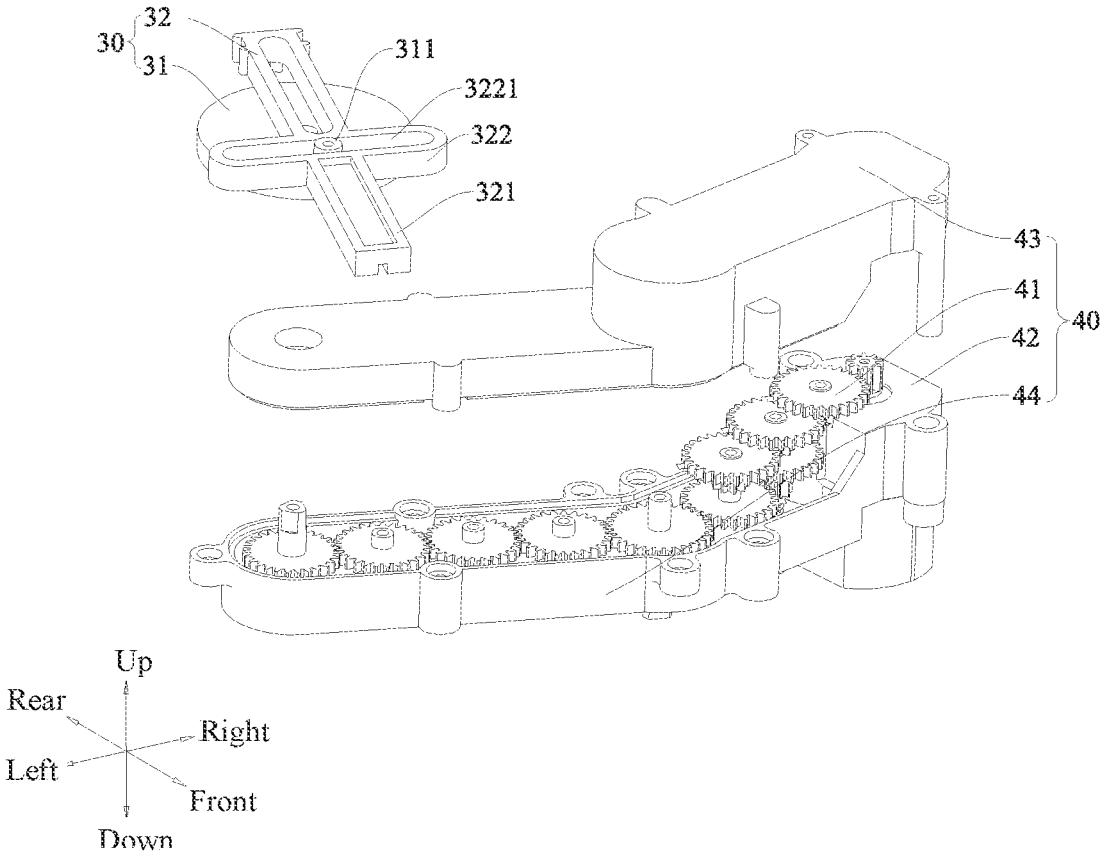
FIG. 5 is a schematic exploded view of a blocking part and a driving part in an embodiment of the present disclosure.

In some embodiments, as shown in FIG. 5, the blocking part 30 includes an eccentric wheel 31 and a push rod 32. The eccentric wheel 31 is pivotably arranged in the housing 10, the push rod 32 is movably arranged in the housing 10 and has an end extending into the ball outlet 102, and the eccentric wheel 31 is slidably connected with the push rod 32 to drive the push rod 32 to extend into or out of the ball outlet 102. It can be understood that, a first end of the push rod 32 is arranged in the ball outlet 102, and the ball 200 is blocked and cannot pass through when arriving here. When the eccentric wheel 31 rotates, the eccentric wheel 31 can drag a second end of the push rod 32 to move, so that the first end of the push rod 32 extends out of the ball outlet 102. At this time, the ball 200 is not blocked and allowed to roll out.

Specifically, as shown in FIG. 5, a driving column 311 is arranged on the eccentric wheel 31, the push rod 32 includes a body portion 321 and a driving portion 322 perpendicular to the body portion 321, the driving portion 322 has a slot 3221, and the driving column 311 is fitted in the slot 3221. In this way, the eccentric wheel 31 can rotate 180 degrees, so as to drive the driving column 311 to slide along the slot 3221, so that the driving portion 322 is pushed to move, and finally the body portion 321 is pushed to extend into the ball sleeve 90 to stop the ball 200. When the eccentric wheel 31 continues to rotate 180° degrees, the driving portion 322 may be dragged to move back, so that the body portion 321 extends out of the ball sleeve 90 to release the ball 200.

In some embodiments, as shown in FIG. 5, the driving part 40 includes a driving motor 42 and a plurality of gears 41 meshing with one another in sequence, the gear 41 of the plurality of gears 41 at an end is connected to the eccentric wheel 31, any one gear 41 of the plurality of gears 41 is connected to the rotating part 20, and the driving motor 42 is connected to the gear 41 of the plurality of gears 41 at another end to drive the plurality of gears 41 to rotate. That is, the driving motor 42 drives one gear 41 to rotate and thus drives all of the gears 41 to rotate. One of the gears 41 is connected to the rotating part 20 to drive the rotating part 20 to rotate, so that the toy 100 can rotate. Another one of the gears 41 is connected to the eccentric wheel 31 to drive the eccentric wheel 31 to rotate, so as to drive the push rod 32 to stop and release the ball 200.

In some embodiments, as shown in FIG. 5, the driving part 40 further includes an upper casing 43 and a lower casing 44, the upper casing 43 is detachably arranged to the lower casing 44, the driving motor 42 is arranged to the upper casing 43, all of the plurality of gears 41 are rotatably arranged to the upper casing 43, and the upper casing 43 and the lower casing 44 are configured to mount the driving motor 42 and the gears 41.

In some embodiments, a controller (not shown in the drawings) is arranged in the housing 10, connected with the driving part 40, the counting part 50, the light-emitting part, the button 70 and the sound-producing part 80, and configured to control the operation of these parts. A switch 104 is arranged on the housing 10, connected with the controller, and configured to turn on or off the early education toy 100.

A specific embodiment of the early education toy 100 of the present disclosure will be described below with reference to the drawings.

As shown in FIG. 1 to FIG. 5, an early education toy 100 is configured to be used with a plurality of balls 200, and includes a housing 10, a rotating part 20, a blocking part 30, a driving part 40, a counting part 50, light-emitting parts, buttons 70 and a sound-producing part 80.

The shape of the housing 10 is configured as a crab with eight legs and two claws, the housing 10 has a ball inlet 101 and a ball outlet 102 and includes a slideway 103 therein, one end of the slideway 103 is connected with the ball inlet 101 and the other end of the slideway 103 is connected with the ball outlet 102. The slideway 103 is a spiral slideway from top to bottom and having an outer ring gradually increasing, and the ball inlet 101 is arranged in a top of the housing 10. The rotating part 20 is pivotably arranged to a bottom of the housing 10.

The blocking part 30 is arranged in the housing 10, and at least part of the blocking part 30 is arranged in the ball outlet 102 or at the end of the slideway 103 adjacent to the ball outlet 102 and configured to reciprocate to stop or release the ball 200. The blocking part 30 includes an eccentric wheel 31 and a push rod 32. The eccentric wheel 31 is pivotably arranged in the housing 10, the push rod 32 is movably arranged in the housing 10 and has an end extending into the ball outlet 102, and the eccentric wheel 31 is slidably connected with the push rod 32 to drive the push rod 32 to extend into or out of the ball outlet 102. A driving column 311 is arranged on the eccentric wheel 31, the push rod 32 includes a body portion 321 and a driving portion 322 perpendicular to the body portion 321, the driving portion 322 has a slot 3221, and the driving column 311 is fitted in the slot 3221.

A driving part 40 is connected to the rotating part 20 and the blocking part 30, and the driving part 40 is configured to drive the blocking part 30 to move and to drive the rotating part 20 to rotate relative to the housing 10. The driving part 40 includes a driving motor 42, a plurality of gears 41 meshing with one another in sequence, an upper casing 43 and a lower casing 44. The gear 41 of the plurality of gears 41 at an end is connected to the eccentric wheel 31, any one gear 41 of the plurality of gears 41 is connected to the rotating part 20, and the driving motor 42 is connected to the gear 41 of the plurality of gears 41 at another end to drive the plurality of gears 41 to rotate. The upper casing 43 is detachably arranged to the lower casing 44, the driving motor 42 is arranged to the lower casing 43, and all of the plurality of gears 41 are rotatably arranged to the upper casing 43.

The counting part 50 is arranged to the ball inlet 101 and the ball outlet 102, and is configured to count the number of entering balls or exiting balls. Nine light-emitting parts are provided and are arranged on the eight legs and one claw of the crab, and all of the nine light-emitting parts are electrically connected with the counting part 50. Each of the light-emitting parts represents a different number of the balls. The nine light-emitting parts are marked with the numbers 1, 2, 3, 4, 5, 6, 7, 8, 9 in sequence. The counting part 50 includes a first leaf switch 51 and a second leaf switch 52. The first leaf switch 51 is arranged to the ball sleeve 90, and the ball 200 triggers the leaf of the first leaf switch 51 when entering the ball inlet 101.

The second leaf switch 52 is arranged to the ball outlet 102, and the ball 200 triggers the leaf of the second leaf switch 52 when rolling out of the ball outlet 102.

The buttons 70 are arranged in one to one correspondence with the light-emitting parts. All of the buttons 70 are electrically connected with the driving part 40. The sound-producing part 80 is electrically connected with the plurality of buttons 70, and is configured to report the number of released balls 200 by voice after the button 70 is triggered.

The ball sleeve 90 is sleeved in the ball inlet 101. The ball sleeve 90 has an opening in its top and a through hole 901 in its side, and the through hole 901 is communicated with the slideway 103.

The ball sleeve 90 includes a mis-trigger preventing mechanism 91, and the mis-trigger preventing mechanism 91 includes a pivotable first trigger 911, a pivotable second trigger 912 and an elastic member 913. The first trigger 911 has a first contact part 9111 extending into the ball sleeve 90, the second trigger 912 has a second contact part 9121 extending into the ball sleeve 90, a side of the second contact part 9121 away from the ball sleeve 90 abuts against the leaf of the first leaf switch 51, and the elastic member 913 is arranged between the first trigger 911 and the second trigger 912. The first trigger 911 is an arc-shaped plate, a first end of the first trigger 911 is rotatably connected to the ball sleeve 90, and a second end of the first trigger 911 is configured as the first contact part 9111. The second trigger 912 is an arc-shaped plate, a first end of the second trigger 912 is rotatably connected to the ball sleeve 90, and a second end of the second trigger 912 is configured as the second contact part 9121.

The elastic member 913 is a spring, an accommodating groove 9112 is formed in the first end of the first trigger 911 adjacent to the second trigger 912, the elastic member 913 is located in the accommodating groove 9112, and the ball sleeve 90 has a positioning plate 914 located in the accommodating groove 9112. A first end of the spring abuts against a wall of the accommodating groove 9112 and a second end of the spring abuts against the positioning plate 914, and the first end of the second trigger 912 abuts against the first trigger 911.

The housing 10 is provided with a movable third trigger 92, an end of the third trigger 92 extends into the ball outlet 102 and another end of the third trigger 92 abuts against the leaf of the second leaf switch 52.

Other structures and operations of the early education toy 100 according to the embodiments of the present disclosure are all known to those skilled in the art, and will not be described in detail here.

In the description of the present disclosure, terms such as "an embodiment", "an example" mean that a particular feature, structure, material, or characteristic described in connection with the embodiment or example is included in at least one embodiment or example of the present disclosure. The exemplary descriptions of the above terms throughout this specification are not necessarily referring to the same embodiment or example. Furthermore, the particular features, structures, materials, or characteristics may be combined in any suitable manner in one or more embodiments or examples.

Although the embodiments of the present disclosure have been shown and described, it would be appreciated by those skilled in the art that changes, modifications, alternatives and variations can be made in these embodiments without departing from the principle and spirit of the present disclosure. The scope of the present disclosure is defined by claims and their equivalents.

What is claimed is:

1. An early education toy configured to be used with at least one ball, the early education toy comprising:

a housing having a ball inlet, a ball outlet, and a slideway, the slideway being disposed in the housing and having an end connected with the ball inlet and another end connected with the ball outlet;

a rotating part pivotably arranged at a bottom of the housing;

a blocking part arranged in the housing, at least one part of the blocking part being arranged in the ball outlet or at the another end of the slideway adjacent to the ball outlet, the at least one part of the blocking part being configured to reciprocate to stop or release the at least one ball;

a driving part connected with the rotating part and the blocking part and configured to drive the blocking part to move and to drive the rotating part to rotate relative to the housing, a counting part arranged at at least one of the ball inlet and the ball outlet to count a number of the at least one ball that enters the ball inlet or exits the ball outlet;

a plurality of light-emitting parts arranged on the housing and electrically connected with the counting part, and each light-emitting part respectively representing a different number of the at least one ball.

2. The early education toy of claim 1, wherein the slideway is a spiral slideway extending from a top of the slideway to a bottom of the slideway, the spiral slideway having an outer ring diameter increasing from the top to the bottom, and the ball inlet is arranged in a top of the housing.

3. The early education toy of claim 1, further comprising:

a plurality of buttons arranged in one to one correspondence with the plurality of light-emitting parts and electrically connected with the driving part, wherein after each button is triggered, the driving part is configured to drive the blocking part to move to release a corresponding number of the at least one ball.

4. The early education toy of claim 3, further comprising:

a sound-producing part electrically connected with the plurality of buttons and configured to report, by voice after each button is triggered, the corresponding number of the at least one ball that is released.

5. The early education toy of claim 1, wherein the ball inlet comprises a ball sleeve, wherein the counting part comprises:

a first leaf switch arranged on the ball sleeve, a leaf of the first leaf switch being configured to be triggered when the at least one ball enters the ball inlet;

a second leaf switch arranged at the ball outlet, and a leaf of the second leaf switch being configured to be triggered when the at least one ball rolls out of the ball outlet.

6. The early education toy of claim 5, wherein the ball sleeve comprises a mis-trigger preventing mechanism, and the mis-trigger preventing mechanism comprises:

a pivotable first trigger having a first contact part extending into the ball sleeve;

a pivotable second trigger having a second contact part extending into the ball sleeve, a side of the second contact part abutting against the leaf of the first leaf switch, the side of the second contact part being away from the ball sleeve;

an elastic member arranged between the pivotable first trigger and the pivotable second trigger.

7. The early education toy of claim 5, wherein the housing comprises a movable third trigger, and the movable third trigger has an end extending into the ball outlet and another end abutting against the leaf of the second leaf switch.

8. The early education toy of claim 1, wherein the blocking part comprises:

an eccentric wheel pivotably arranged in the housing;

a push rod movably arranged in the housing and having an end extending into the ball outlet, the eccentric wheel being slidably connected with the push rod to drive the push rod to extend into or out of the ball outlet.

9. The early education toy of claim 8, wherein the driving part comprises:

a plurality of gears meshing with one another in sequence, one gear of the plurality of gears at an end of the driving part being connected to the eccentric wheel, any one gear of the plurality of gears being connected to the rotating part; and a driving motor connected to another gear of the plurality of gears at another end of the driving part to drive the plurality of gears to rotate.

* * * * *